US010271415B2

(12) United States Patent
Nikic

(10) Patent No.: US 10,271,415 B2
(45) Date of Patent: Apr. 23, 2019

(54) SEMICONDUCTOR MICRO-HOLLOW CATHODE DISCHARGE DEVICE FOR PLASMA JET GENERATION

(71) Applicant: The Boeing Company, Chicago, IL (US)

(72) Inventor: Dejan Nikic, Seattle, WA (US)

(73) Assignee: The Boeing Company, Chicago, IL (US)

( * ) Notice: Subject to any disclaimer, the term of this patent is extended or adjusted under 35 U.S.C. 154(b) by 399 days.

(21) Appl. No.: 15/143,517

(22) Filed: Apr. 30, 2016

(65) Prior Publication Data

US 2017/0318654 A1 Nov. 2, 2017

(51) Int. Cl.
*H05H 1/24* (2006.01)

(52) U.S. Cl.
CPC ..... *H05H 1/2406* (2013.01); *H05H 1/24* (2013.01); *H05H 2001/2412* (2013.01)

(58) Field of Classification Search
None
See application file for complete search history.

(56) References Cited

U.S. PATENT DOCUMENTS 8,101,923 B2 * 1/2012 Orlando ..... H01J 49/162 250/281
9,057,994 B2 * 6/2015 Rogers ..... G03G 15/323
9,061,494 B2 * 6/2015 Rogers ..... B41J 2/06
9,711,333 B2 * 7/2017 Sieber ..... H01J 37/32449
2002/0036461 A1 * 3/2002 Schoenbach ..... H01J 1/025 313/495
2004/0144733 A1 * 7/2004 Cooper ..... C02F 1/325 210/748.13
2006/0012277 A1 * 1/2006 Park ..... B82Y 10/00 313/309
2006/0028145 A1 * 2/2006 Mohamed ..... H05H 1/2406 315/111.21
2006/0054279 A1 * 3/2006 Kim ..... H01L 21/02071 156/345.33

(Continued)

FOREIGN PATENT DOCUMENTS

JP 2012159777 8/2012

OTHER PUBLICATIONS

Schoenbach et al., "Microhollow cathode discharges," American Institute of Physics, 1996, 3 pages.

(Continued)

*Primary Examiner* — Douglas W Owens
*Assistant Examiner* — Srinivas Sathiraju
(74) *Attorney, Agent, or Firm* — Yee & Associates, P.C.

(57) ABSTRACT

A micro-hollow cathode discharge device. The device includes a first electrode layer comprising a first electrode. A hole is disposed in the first electrode layer. The device also includes a dielectric layer having a first surface that is disposed on the first electrode layer. The hole continues from the first electrode layer through the dielectric layer. The device also includes a semi-conducting layer disposed on a second surface of the dielectric layer opposite the first surface. The semi-conducting layer is a semiconductor material that spans across the hole such that the hole terminates at the semi-conducting layer. The device also includes a second electrode layer disposed on the semi-conducting layer opposite the dielectric layer.

20 Claims, 8 Drawing Sheets

(56) References Cited

U.S. PATENT DOCUMENTS

| | | | | |
|---|---|---|---|---|
| 2007/0200499 | A1* | 8/2007 | Eden | H01J 9/245 313/582 |
| 2009/0121127 | A1* | 5/2009 | Orlando | H01J 49/142 250/282 |
| 2014/0265036 | A1* | 9/2014 | Eden | H01J 9/245 264/402 |
| 2015/0239552 | A1 | 8/2015 | Nikic | |
| 2016/0107203 | A1 | 4/2016 | Nikic | |
| 2016/0329191 | A1* | 11/2016 | Sieber | H01J 37/32449 |
| 2016/0329192 | A1* | 11/2016 | Sieber | H01J 37/32825 |
| 2016/0329193 | A1* | 11/2016 | Sieber | H01J 37/32449 |

OTHER PUBLICATIONS

Hwang et al., "Diffusion-Controlled Glow Discharge Pressure Extended by the Multi-Dual Microhollow Cathode Configuration for Flat Lighting," The Japan Society of Applied Physics, 2010, 3 pages.
Becker et al., "Microplasmas and applications," Institute of Physics Publishing, Journal of Physics D: Applied Physics 39, 2006, 17 pages.
Shi et al., "Parallel Operation of Microhollow Cathode Discharges," IEEE Transactions on Plasma Science, vol. 27, No. 1, Feb. 1999, 2 pages.
Kim et al., "A Micromachined Flexible Hollow Cathode Discharge Device," Japanese Journal of Applied Physics 48, 2009, 4 pages.
Fukuhara et al., Characterization of a Microhollow Cathode Discharge Plasma in Helium or Air with Water Vapor, Plasma Science and Technology, vol. 15, No. 2, Feb. 2013, 4 pages.
Kolb et al.,"Cold atmospheric pressure air plasma jet for medical applications," American Institute of Physics, Applied Physics Letters 92, 241501, 2008, 4 pages.
Biborosch et al., "The Influence of an External Magnetic Field on a "Macro" Hollow Cathode Discharge in Argon," 28th ICPIG, Jul. 15-20, 2007, Prague, Czech Republic, 4 pages.
Extended European Search Report, dated Oct. 13, 2017, regarding Application No. 17156101.2, 9 pages.
Zhang et al.,"Simulation of Microhollow Cathode Discharge with Planar and Hollow Anodes," Transaction on Plasma Science, vol. 37, No. 10, Oct. 2009, 6 pages.
Winter et al., "Atmospheric Pressure Plasma Jets: an Overview of Devices and New Directions," Plasma Sources Science and Technology, vol. 24, No. 6, Published Oct. 8, 2015, 19 pages.
Li et al., "Diagnosis on the Molecular vibrational Temperature of a Micro-Plasma Jet Operated at Atmospheric Pressure," 2010 International Conference on Electrical and Control Engineering, 4 pages.
Niisshin Em Co. Ltd., "Carbon Conductive Double-Faced Adhesive Tapes, Tabs, and Sheets," Retrieved from the Internet, URL, http://nisshin-em.co.jp/english/carbontape.html, retrieved on Dec 12, 2017, 3 pages.
Nehra et al., "Atmospheric Non-Thermal Plasma Sources," International Journal of Engineering, vol. 2, No. 1, 16 pages.

* cited by examiner

1000

$$kT = \frac{E_{m2} - E_{m1}}{\ln\left(\frac{I_1 \lambda_2 g_{m2} A_{n2}}{I_2 \lambda_1 g_{m1} A_{n1}}\right)}$$

1100

| SPECTRAL LINE 1 | SPECTRAL LINE 2 | SC-MHCD $T_e$ | ACCURACY [10] |
|---|---|---|---|
| O-II 394.28 | O-III 396.16 | 1.23 eV | 50% |
| O-III 396.16 | O-II 396.73 | 1.86 eV | 25% |
| O-III 415.65 | O-II 419.62 | 1.43 eV | 50% |

SEMICONDUCTOR MICRO-HOLLOW CATHODE DISCHARGE DEVICE FOR PLASMA JET GENERATION

BACKGROUND INFORMATION

1. Field

The present disclosure relates to plasma jet generation in micro-hollow cathode discharge devices.

2. Background

Plasma jets have many useful applications. For example, plasma jet generators may be placed on a spacecraft, and then the plasma jet may be used as a thruster. Plasma jet generators have various other applications in industry and medicine.

For some applications, generation of plasma jets of a desirable size is only possible using an external gas flow to enhance the length of the plasma jet. However, integrating plasma jet generators that rely on gas flow may be problematic in applications where only thin structures or confined spaces are available, because gas flow-based plasma jet generators tend to be too bulky for such applications.

SUMMARY

The illustrative embodiments provide for a micro-hollow cathode discharge device. The device includes a first electrode layer comprising a first electrode. A hole is disposed in the first electrode layer. The device also includes a dielectric layer having a first surface that is disposed on the first electrode layer. The hole continues from the first electrode layer through the dielectric layer. The device also includes a semi-conducting layer disposed on a second surface of the dielectric layer opposite the first surface. The semi-conducting layer is a semiconductor material that spans across the hole such that the hole terminates at the semi-conducting layer. The device also includes a second electrode layer disposed on the semi-conducting layer opposite the dielectric layer.

The illustrative embodiments also provide for a method of generating a plasma jet from a micro-hollow cathode discharge device comprising a first electrode layer comprising a first electrode, wherein a hole is disposed in the first electrode layer; a dielectric layer having a first surface that is disposed on the first electrode layer, wherein the hole continues from the first electrode layer through the dielectric layer; a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer. The method includes generating a plasma jet from the hole by applying a voltage across the first electrode and the second electrode.

The illustrative embodiments also provide for a method of manufacturing a micro-hollow cathode discharge device. The method includes manufacturing a dielectric layer having a first surface and a second surface opposite the first surface. The method also includes placing a first electrode layer comprising a first electrode onto the first surface, wherein a hole is disposed in the first electrode layer. The hole continues from the first electrode layer through the dielectric layer. The method also includes placing a semi-conducting layer onto the second surface of the dielectric layer. The semi-conducting layer includes a semiconductor material that spans across the hole such that the hole terminates at the semi-conducting layer. The method also includes placing a second electrode layer onto the semi-conducting layer opposite the dielectric layer.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account that advances in power supply technology have made simple atmospheric plasma sources readily achievable. These devices can be used for processing, flow control, medical applications, thrusters, etc. Exact application will determine the configurations of the device itself. One of the simplest configurations for generation of plasma jets are micro-hollow cathode discharges (MHCD). Traditional MHCD devices have been operated under a range of pressure conditions and gas mixtures. However, operations in air have been performed either with lower than atmospheric pressures or using an external supply of air flow on the order of 100 m/s.

For many industrial applications a preferred plasma generator would not require external gas supply and would be able to operate at atmospheric conditions. Achieving such operational parameters would allow miniaturization of the device and easily integrate it into a variety of structures. Formed and flexible MHCD devices would also be easier to manufacture.

Thus, improvements to a micro-hollow cathode discharge are made to enhance the plasma jet exhaust with the assistance of a semi-conducting layer inserted at the bottom of the cathode hole. Large plasma jets are observed using micro-hollow cathode discharge devices without the need for an external source of high velocity gas. With the proposed configuration 10-20 mm long plasma jets are produced with exhaust velocities of 45 m/s. Further investigations, which included high speed imaging and spectroscopy, are performed. Based on the findings it has been concluded that compact high-performance plasma jets are possible.

Figure 1:
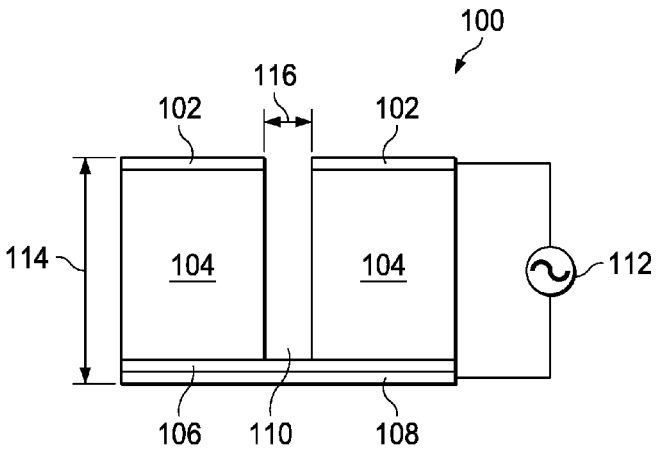
FIG. 1 is an illustration of a semi-conducting micro-hollow cathode discharge device, in accordance with an illustrative embodiment.

FIG. 1 illustrates a semi-conducting micro-hollow cathode discharge device, in accordance with an illustrative embodiment. Semi-conducting micro-hollow cathode discharge device 100 includes several components. Structurally, semi-conducting micro-hollow cathode discharge device 100 includes four layers, including first electrode layer 102, dielectric layer 104, semi-conductor layer 106, and second electrode layer 108. Hole 110 extends through first electrode layer 102 and dielectric layer 104 to semi-conductor layer 106. Power supply 112 provides power to an electrode in first electrode layer 102 and to another electrode in second electrode layer 108.

Overall, semi-conducting micro-hollow cathode discharge device 100 may have dimensions as indicated by height arrows 114 and width arrows 116. In some illustrative embodiments, the height may be about 1.5 mm. The width of hole 110 may be 0.4 mm. The hole may be circular in some illustrative embodiments, with a radius of 0.4 mm. The overall width along width arrows 116 may be centimeters or longer. The breadth of semi-conducting micro-hollow cathode discharge device 100 (into and out of the page) may also be centimeters or longer. These dimensions may all be varied and do not necessarily limit the illustrative embodiments. The dimensions and shape of hole 110 may be generally in a range of about 0.1 mm to about 2 mm. The height of semi-conducting micro-hollow cathode discharge device 100 along height arrows 114 may vary between about 0.5 mm and 10 mm or greater. However, in some cases, even these ranges may be expanded.

Attention is now turned to an exemplary experimental apparatus used in developing and implementing the illustrative embodiments described herein. The following is exemplary only, as other apparatus may be used to implement the illustrative embodiments described herein.

A micro-hollow cathode discharge device (MHCD) is composed of a dielectric layer and metallic electrodes attached to the dielectric. Such devices may be built utilizing printed circuit boards (PCBs). A central hole in the micro-hollow cathode discharge device could be thought of as a vertical interconnect access (VIA) hole present in most circuit board designs.

The illustrative embodiments present a new configuration of a micro-hollow cathode discharge device to increase the performance of the plasma jet in atmospheric air. To enhance the performance of the micro-hollow cathode discharge device, a semi-conducting layer may be attached between one of the electrodes and the dielectric. This arrangement is shown in FIG. 1, where a cross-section of the device is drawn with primary layers of the device shown. Enclosing one end of the hole with the semi-conducting layer forces the electrical path between the two electrodes to include the semi-conductor as well. This configuration may be designated as a semi-conducting micro hollow cathode discharge (SC-MHCD).

Figure 2:
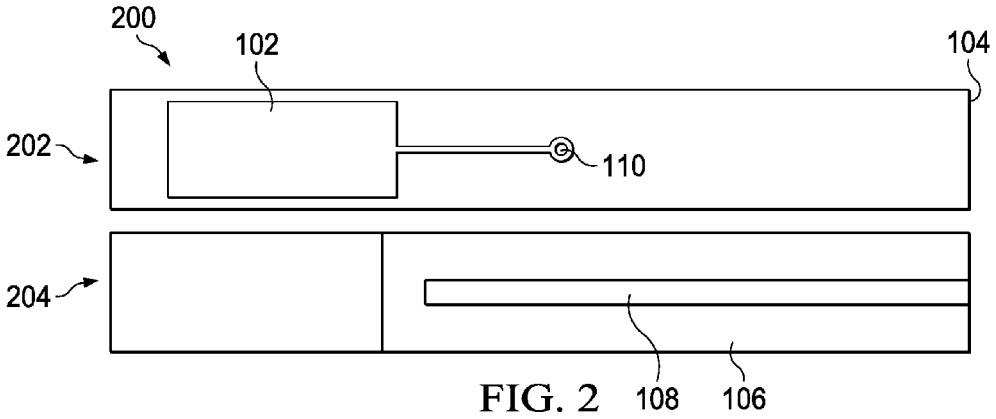
FIG. 2 is an illustration of a printed circuit board version of a semi-conducting micro-hollow cathode discharge device, in accordance with an illustrative embodiment.

FIG. 2 illustrates a printed circuit board version of a semi-conducting micro-hollow cathode discharge device, in accordance with an illustrative embodiment. Semi-conducting micro-hollow cathode discharge device 200 may be semi-conducting micro-hollow cathode discharge device 100. Thus, reference numerals in common with FIG. 1 share similar names and descriptions.

In FIG. 2, two views of semi-conducting micro-hollow cathode discharge device 200 are shown, a first side and a second side opposite the first side. First side 202 includes hole 110 and first electrode layer 102. Second side 204 showing both semi-conductor layer 106 and second electrode layer 108.

Attention is now turned to continuing the exemplary experimental apparatus of FIG. 1 used in developing and implementing the illustrative embodiments described herein. The following is exemplary only, as other experimental apparatus may be used to implement the illustrative embodiments described herein. Thus, the arrangement and shape of layers and other aspects of semi-conducting micro-hollow cathode discharge device 200 are not necessarily limited to what is shown or described in the following examples.

In the illustrative embodiment of FIG. 2, a small toroidal electrode, first electrode layer 102, is shown in the middle of the device. Hole 110 may be at a center of the toroid. Hole 110 may extend to semi-conductor layer 106 on the opposite side of the circuit board. Also shown are dielectric layer 104 and second electrode layer 108.

For rapid testing, a quick way to connect or disconnect the power supply from the semi-conducting micro-hollow cathode discharge device may be provided. Wide pads connected to electrodes may be printed on a printed circuit board to ensure sufficient connection for alligator clips. Other types of electrode contacts may be used.

To create semi-conductor layer 106, a layer of carbon tape may be used. Carbon tape can be seen in FIG. 2 on second side 204 of semi-conducting micro-hollow cathode discharge device 200. In some illustrative embodiments, tape only needs to be applied to the small electrode area directly surrounding hole 110. For ease of manufacture, the tape may completely cover second side 204 of semi-conducting micro-hollow cathode discharge device 200.

Devices based on printed circuit board panels may show undesirable erosion in use, particularly on the dielectric which may show signs of melting. This erosion and melting may occur when copper and FR-4 are used for the dielectric on the printed circuit board. FR-4 is a grade designation assigned to glass-reinforced epoxy laminate sheets, tubes, rods and printed circuit boards. FR-4 is a composite material composed of woven fiberglass cloth with an epoxy resin binder that is flame resistant.

To achieve higher durability, 1.5 mm thick plates of MACOR® ceramic may be used to fabricate semi-conducting micro-hollow cathode discharge device 200. MACOR® is the trademark for a machinable glass-ceramic developed and sold by Corning Inc. MACOR® is composed of fluorphlogopite mica in a borosilicate glass matrix. However, plates of other materials may be used to achieve higher durability, including other types of ceramic materials.

To manufacture semi-conducting micro-hollow cathode discharge device 200, copper foil may be placed on the ceramic and a hole drilled through the foil and ceramic at the same time. A 400 micrometers drill bit may be used, but other drill bit sizes may be used for different illustrative embodiments. A second electrode may be built using layers of carbon tape and copper applied to the back of the ceramic substrate. These devices may built identical to the printed circuit board device shown in FIG. 2 and were shown to perform similarly. All of the data presented in this document is based on the semi-conducting micro-hollow cathode discharge devices built using the above arrangement of materials and techniques.

Figure 3:
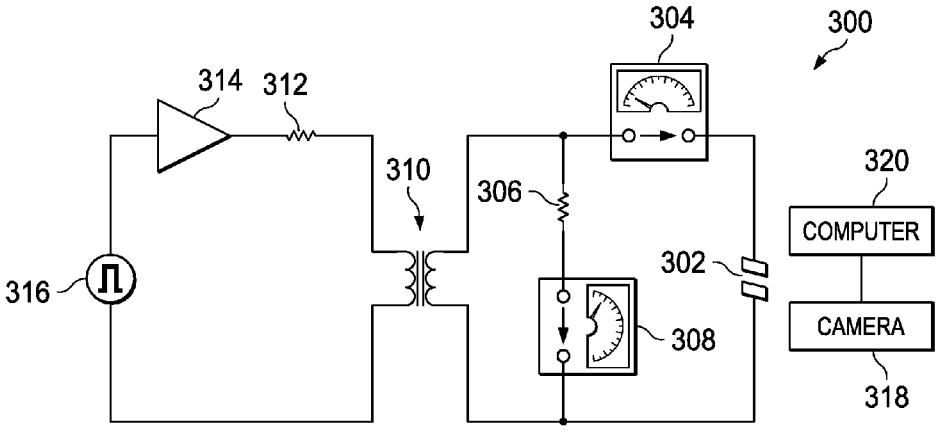
FIG. 3 is an illustration of an electrical schematic of a semi-conducting micro-hollow cathode discharge device, in accordance with an illustrative embodiment.

FIG. 3 illustrates an electrical schematic 300 of a semi-conducting micro-hollow cathode discharge device, in accordance with an illustrative embodiment. Semi-conducting micro-hollow cathode discharge device 302 may be semi-conducting micro-hollow cathode discharge device 100 of FIG. 2 or semi-conducting micro-hollow cathode discharge device 100 of FIG. 1.

Semi-conducting micro-hollow cathode discharge device 302 is connected to current probe 304, resistor 306, second current probe 308, and transformer 310, as shown in FIG. 3. Transformer 310 may be a high voltage flyback transformer, but other transformers or other devices capable of scaling up the voltage may be used. In turn, transformer 310 may be connected to resistor 312, power amplifier 314, and pulse generator 316, as arranged in FIG. 3. Camera 318 may be positioned to take images of a plasma jet emitted from semi-conducting micro-hollow cathode discharge device 302. Computer 320 may be in communication with camera 318 in order to record and process data taken by camera 318.

Other electrical arrangements are possible. In some illustrative embodiments one or both resistors may not be necessary or desirable. More or fewer current probes, or no current probes, may be present. A pulse generator may not be present. Thus, the illustrative embodiments are not necessarily limited to the example shown in FIG. 3.

Attention is now turned to continuing the specific exemplary apparatus of FIG. 1 and FIG. 2 used in developing and implementing the illustrative embodiments described herein. The following is exemplary only, as other experimental apparatus may be used to implement the illustrative embodiments described herein.

To power the semi-conducting micro-hollow cathode discharge device, a high voltage power supply may be used with the set of components shown in FIG. 3. Pulse generator 316 may be used to generate a low voltage rectangular signal, equivalent to a transistor-transistor logic (TTL) signal. The signal lasts 100 microseconds and is amplified with power amplifier 314. In a specific non limiting illustrative embodiment, power amplifier 314 may be an AE TECHRON MODEL 8101®.

To obtain high voltage, a flyback transformer may be used for transformer 310. The primary winding of the transformer may be connected to power amplifier 314, while the secondary is connected to semi-conducting micro-hollow cathode discharge device 302.

Resistor 312 may be used in series with power amplifier 314 to limit the current. Limiting the current may be performed to protect transformer 310. Thus, in different illustrative embodiments where transformer 310 does not need protection from a current generated by a particular arrangement, resistor 312 may not be needed or desirable.

To monitor the input of power to semi-conducting micro-hollow cathode discharge device 302, two current transformers (CTs) may be used, current probe 304 and current probe 308. In a specific illustrative embodiment, both current transformers may be PEARSON ELECTRONICS MODEL 2100®. The first current transformer, current probe 304, may be attached to the high voltage side of semi-conducting micro-hollow cathode discharge device 302, and it measures the current supplied to semi-conducting micro-hollow cathode discharge device 302. The second current transformer, current probe 308, measures current through a resistor connected in parallel with semi-conducting micro-hollow cathode discharge device 302. In a specific illustrative embodiment, resistor 306 may be about 40 kΩ. This measurement allows indirect measurement of the voltage across semi-conducting micro-hollow cathode discharge device 302 with decreased noise compared to voltage measurements performed directly using a high voltage probe.

As indicated above, camera 318 may be used to take images of the plasma jet emitted from semi-conducting micro-hollow cathode discharge device 302. In a specific illustrative embodiment, a NIKON D800® camera may be used to capture long exposure images of jets, while a VISION RESEARCH PHANTOM V640® camera may be used to provide high-speed imagery at 20,000 frames per second.

Spectroscopic measurements of the jets may be taken using an ANDOR SHAMROCK 500® spectrometer outfitted with ISTAR 320T® intensified charged couple device (CCD) camera. The light of the plasma jet may be coupled to the spectrometer via an optical fiber.

The measurements described herein may be used to obtain ionizing species information during testing. For initial surveying of the spectrum, a 300 l/mm grating may be utilized. Data presented in this document was obtained using a high resolution 1800 l/mm grating. A higher resolution grating may be chosen as a good compromise between wavelength resolution and detectable wavelength span. With a 1800 l/mm grating it was possible to obtain the spectral information spanning from 350 nm to 650 nm in 15 separate shots with a spectral resolution of 0.07 nm.

Figure 4:
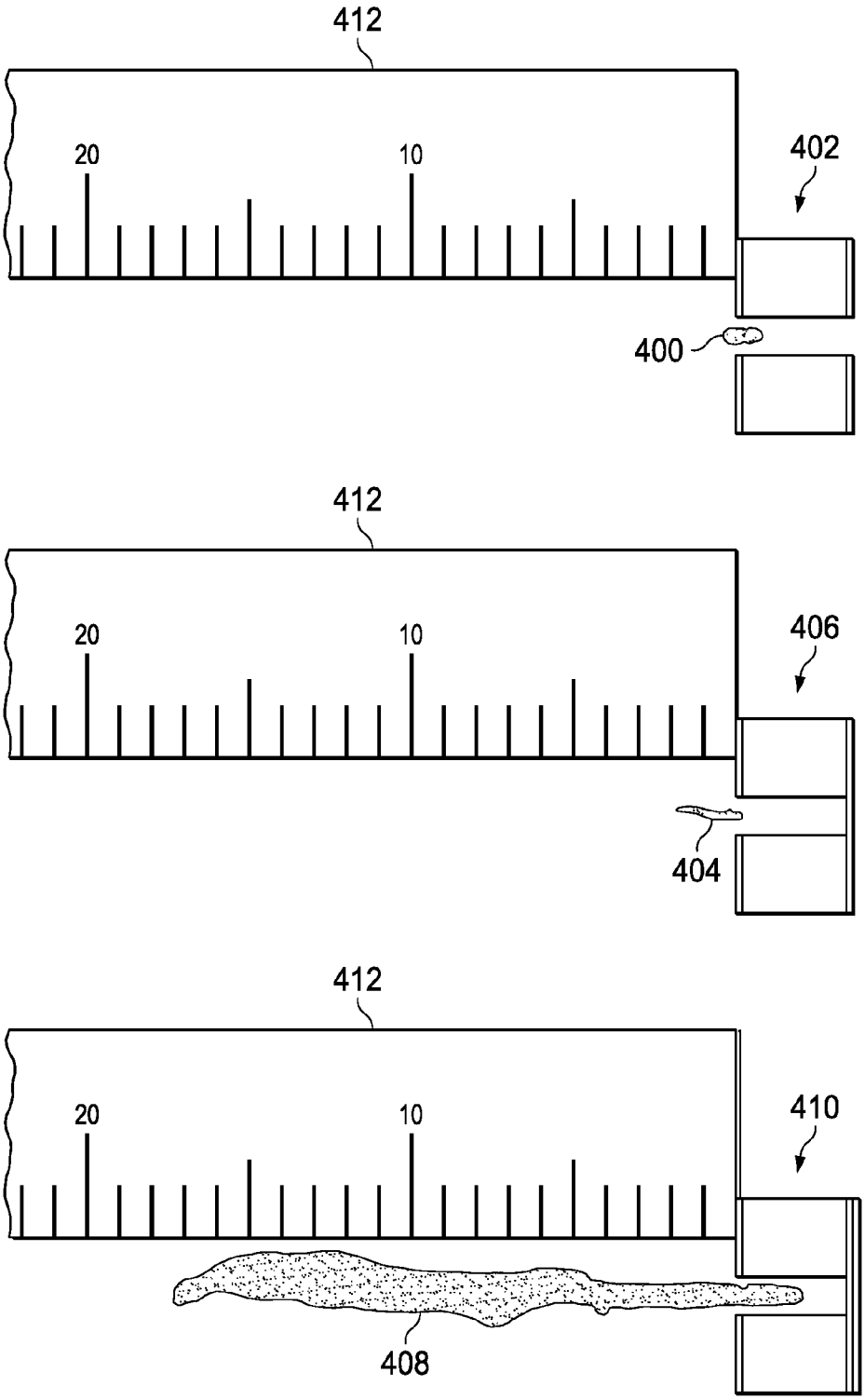
FIG. 4 is an illustration of a micro-hollow cathode discharge devices for purpose of comparing the resulting plasma jets for each device, in accordance with an illustrative embodiment.

FIG. 4 illustrates micro-hollow cathode discharge devices for purpose of comparing the resulting plasma jets for each device, in accordance with an illustrative embodiment. Thus, plasma jet 400 is generated by micro-hollow cathode discharge device 402; plasma jet 404 is generated by micro-hollow cathode discharge device 406; and plasma jet 408 is generated by semi-conducting micro-hollow cathode discharge device 410. For each jet, the same ruler 412 is used to measure the length of the jet. Micro-hollow cathode discharge device 402 uses a hole that extends through both electrodes and the dielectric material, with no semiconductor layer. Micro-hollow cathode discharge device 406 uses a hole that extends to but not through the second electrode, with no semiconducting layer. Semi-conducting micro-hollow cathode discharge device 410 uses the arrangement shown in FIG. 1 and FIG. 2.

The measurements and illustrative embodiments described with respect to FIG. 4 are exemplary only, and may be varied. However, the measurements shown were taken with the specific exemplary experimental apparatus described above with respect to FIG. 1 through FIG. 3.

Continuing that example, comparison of different micro-hollow cathode discharge device configurations is shown in FIG. 4. The top two configurations are as described above. As shown in the right column of FIG. 4, penetration of the jets for these common configurations is poor. However, for semi-conducting micro-hollow cathode discharge device 410, a comparatively much larger jet is measured shooting out of the hole up to 15 mm in length, compared with at most 2 mm for micro-hollow cathode discharge device 406.

For each of the configurations investigated, a number of tests were performed to eliminate the effects of noise, fabrication inconsistencies, etc. With dozens of separate shots, each of the configurations performed consistently and only semi-conducting micro-hollow cathode discharge device 410 showed a significant improvement in jet size.

Based on these results a closer examination of semi-conducting micro-hollow cathode discharge device 410 was warranted. Semi-conducting micro-hollow cathode discharge device 410 showed a significant increase in jet size, which was not expected based on previous research shown at micro-hollow cathode discharge device 402 and micro-hollow cathode discharge device 406. The primary difference between the devices is that there is a layer of conductive carbon tape applied to the bottom electrode of semi-conducting micro-hollow cathode discharge device 410.

The tape used may be a scanning electron microscope (SEM) tape made by NISSHIN EM CO. and may be approximately 120 micrometers thick. In some cases the tape may be consumed during the jetting process. After a number of shots, usually more than 20, a single layer of SEM tape may be consumed. Multiple layers of SEM tape may be used to increase the number of available shots. No performance loss was noted with up to five layers of tape.

Using the methods described above, the electrical properties of semi-conducting micro-hollow cathode discharge device 410 were measured to determine power requirements. Based on the observation of many shots, only slight changes in electrical behavior were observed from shot to shot. The electrical properties of semi-conducting micro-hollow cathode discharge device 410 are described further below with respect to FIG. 5.

Figure 5:
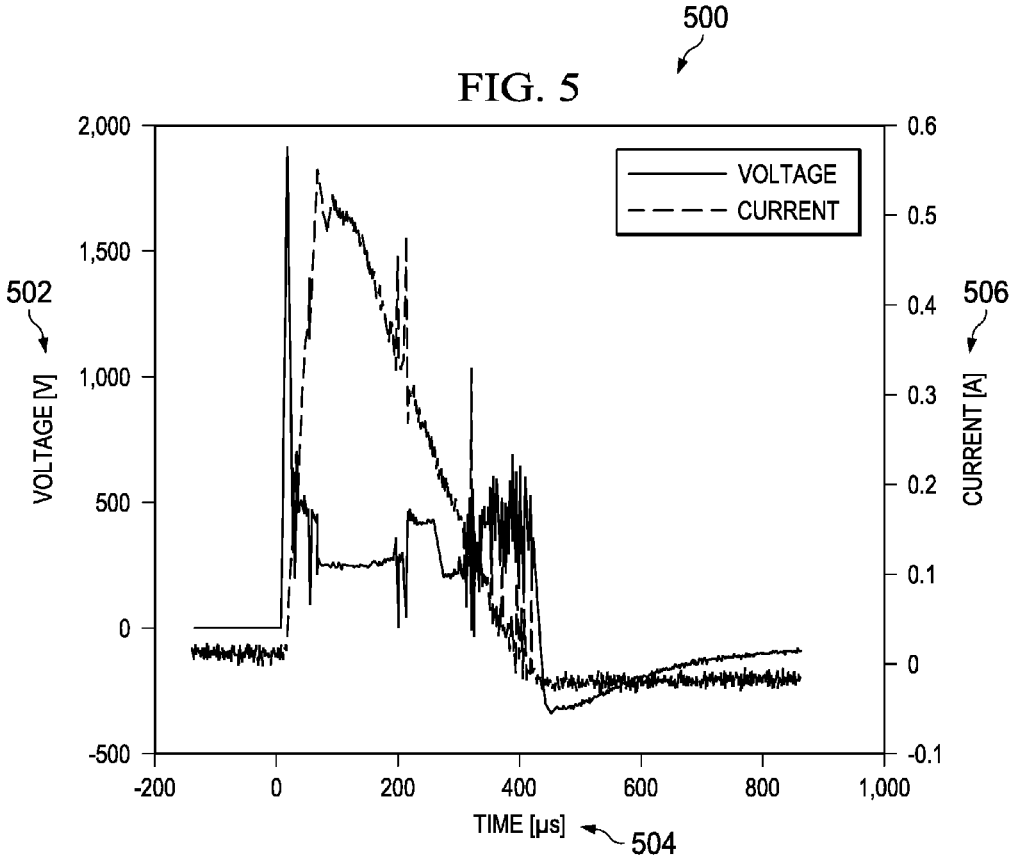
FIG. 5 is an illustration of a graph of electrical properties of a semi-conducting micro-hollow cathode discharge device, in accordance with an illustrative embodiment.

FIG. 5 is a graph of electrical properties of a semi-conducting micro-hollow cathode discharge device, in accordance with an illustrative embodiment. Graph 500 displays voltage 502 versus time 504 versus current 506 taken for a semi-conducting micro-hollow cathode discharge device, such as those described with respect to FIG. 1 through FIG. 4.

Attention is now turned to continuing the exemplary experimental apparatus of FIG. 1 through FIG. 4 used in developing and implementing the illustrative embodiments described herein. The following is exemplary only, as other experimental apparatus may be used to implement the illustrative embodiments described herein.

Full traces of current and voltage are shown in FIG. 5. Electrical properties of semi-conducting micro-hollow cathode discharge device 410 show a capacitive nature of the discharge with peak current of 500 mA. Initially the discharge requires a high voltage spike of almost 2000 V, which initiates the breakdown and generates the plasma. Once plasma is formed, a steady-state regime is entered during which voltage of 300-500 V is sufficient. The average power for the duration of the shot was computed to be 34.7 W.

A variety of current and voltage pulses to the semi-conducting micro-hollow cathode discharge device may be possible. However, the transformer used to generate the high voltage pulse for a discharge should accommodate the current. Inductive loading and discharge of the transformer provides the energy to the semi-conducting micro-hollow cathode discharge device, thereby limiting the nature of the current pulse in some applications. During high speed tests, the duty cycle of the power supply may be increased to determine if a near-steady stream of jets would be attainable.

With the example described above, a series of shots at a 100 Hz rate were performed. The power supply should provide sufficient power to generate jets at this rate. At 100 Hz discharges appear to behave uniformly throughout the duration of the high duty cycle test. With increased duty cycle the consumption of carbon tape increases as well. For these tests, multiple layers of carbon tape were used, which allowed 4-5 seconds of runtime at 100 Hz. Once the carbon tape is consumed the jetting process becomes sporadic and eventually starts to behave as plasma jet 404 from micro-hollow cathode discharge device 406 of FIG. 4.

Figure 6:
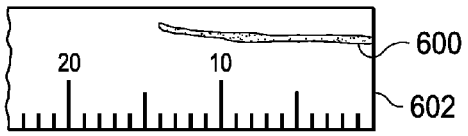
FIG. 6 is an illustration of a measurement of a jet from a semi-conducting micro-hollow cathode discharge device, in accordance with an illustrative embodiment.

FIG. 6 illustrates a measurement of a jet from a semi-conducting micro-hollow cathode discharge device, in accordance with an illustrative embodiment. Plasma jet 600 is another plasma jet generated using a semi-conducting micro-hollow cathode discharge device, such as those described with respect to FIG. 1 through FIG. 4. Ruler 602, which is the same as ruler 412 of FIG. 4, shows a measurement of plasma jet 600. Note that for different configurations of the semi-conducting micro-hollow cathode discharge device, different measurements may be observed.

Attention is now turned to continuing the exemplary experimental apparatus of FIG. 1 through FIG. 5 used in developing and implementing the illustrative embodiments described herein. The following is exemplary only, as other experimental apparatus may be used to implement the illustrative embodiments described herein.

FIG. 6 is derived from an actual high fidelity photograph of plasma jet 600, taken with a high resolution digital single lens reflex camera. The semi-conducting micro-hollow cathode discharge device of the illustrative embodiments produced a jet large enough that a standard ruler was sufficient for rough measurements of jet penetration. On average, jets of 10-20 mm length were achieved with ease.

Figure 7:
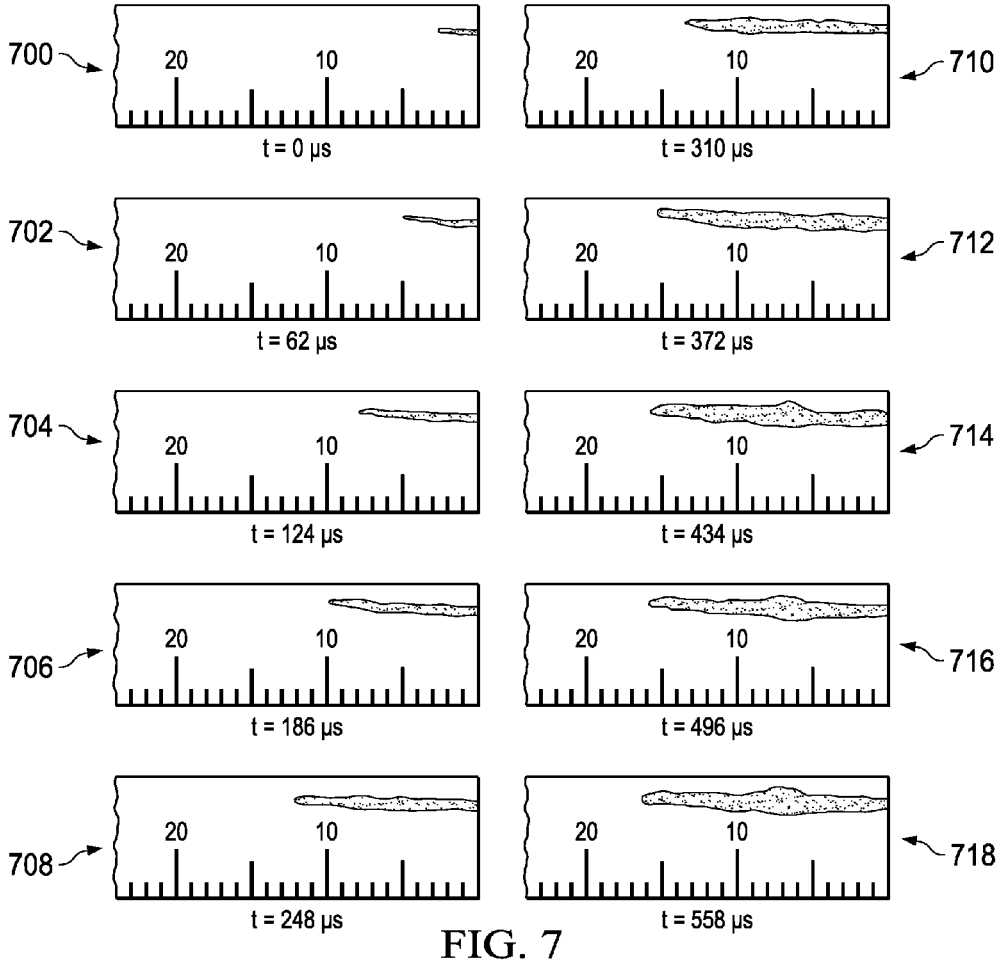
FIG. 7 is an illustration of a series of high speed images of plasma jets generated by a semi-conducting micro-hollow cathode discharge device, in accordance with an illustrative embodiment.

FIG. 7 is a series of high speed images of plasma jets generated by a semi-conducting micro-hollow cathode discharge device, in accordance with an illustrative embodiment. The semi-conducting micro-hollow cathode discharge device used to take the series of images shown in FIG. 7 may be any of the semi-conducting micro-hollow cathode discharge devices described with respect to FIG. 1 through FIG. 4.

The single shot nature of semi-conducting micro-hollow cathode discharge device prompted investigation of the temporal variation of the jet. A high speed camera was used to capture the development of a jet for the duration of the electrical current pulse. The results are shown in FIG. 7. The sequence of images proceeds in order from image 700 to image 702, image 704, image 706, image 708, image 710, image 712, image 714, image 716, and finally image 718. The time from initiation of the plasma jet is shown in each image.

The camera was triggered from the leading edge of the transistor-transistor logic (TTL) signal generated with a signal generator, which may be pulse generator 316 of FIG.

3. Due to the relative low-light nature of the plasma jet from the semi-conducting micro-hollow cathode discharge device, a full inter-frame time was used for exposure time, in this case 62 microseconds. The camera timestamps image 700 at just after 0 microseconds, yet the first evidence of the exhausting jet is already seen. This result is a side effect of a long exposure time in a rapidly changing environment around the semi-conducting micro-hollow cathode discharge device.

Figure 8:
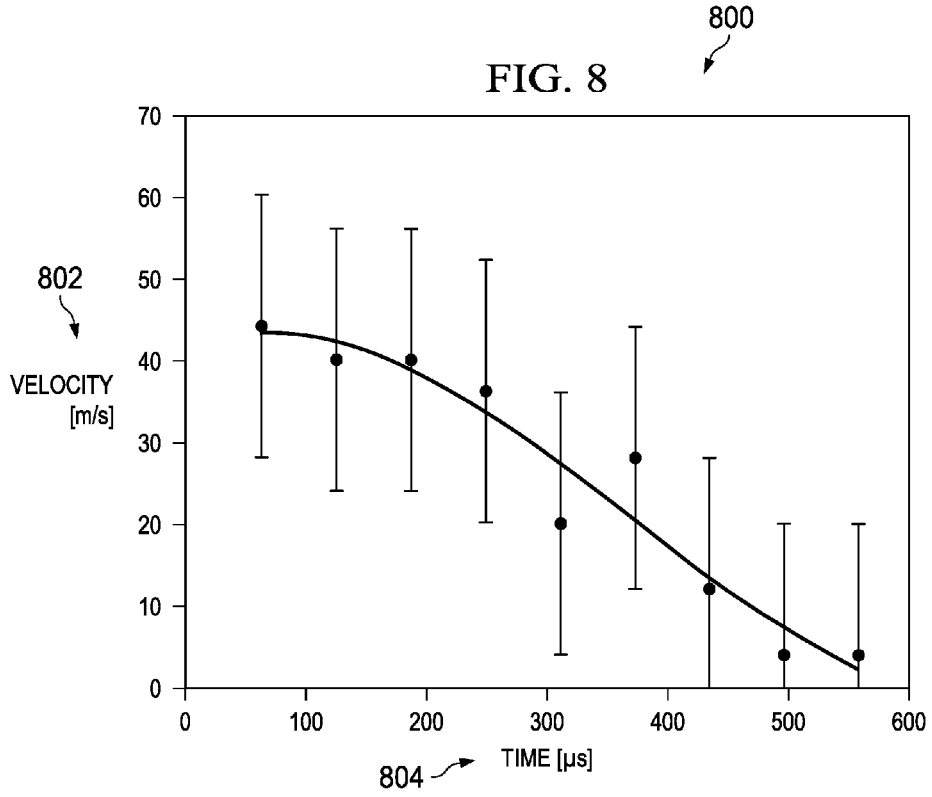
FIG. 8 is an illustration of a graph of approximate velocity of a ballasted plasma jet generated by a semi-conducting micro-hollow cathode discharge device, in accordance with an illustrative embodiment.

FIG. 8 is a graph of approximate velocity of a ballasted plasma jet generated by a semi-conducting micro-hollow cathode discharge device, in accordance with an illustrative embodiment. Graph 800 was generated by measuring a plasma jet from a semi-conducting micro-hollow cathode discharge device, such as those described with respect to FIG. 1 through FIG. 4. Graph 800 represents a relationship between velocity 802 of the plasma jet and time 804 after initiation of the plasma jet.

Attention is now turned to continuing the exemplary experimental apparatus of FIG. 1 through FIG. 7 used in developing and implementing the illustrative embodiments described herein. The following is exemplary only, as other experimental apparatus may be used to implement the illustrative embodiments described herein.

Approximation of the length growth of the jet can be made directly from the high-speed camera images shown in FIG. 7. In conjunction with the timing information provided by the camera, approximate exhaust velocity values can be computed. Velocities as function of time are shown in FIG. 8. These results were computed using the values obtained from images shown in FIG. 7.

Peak velocity of the jet happens during the initial phase of the pulse. The highest power levels of the electrical pulse are also measured during this time. This method allows an estimate of the exhaust velocities. With the peak velocity of 45 m/s, the semi-conducting micro-hollow cathode discharge device generates plasma jets that are 5-10 times slower than existing semi-conducting micro-hollow cathode discharge devices that utilize external gas flow.

The example described above can be varied to further improve the above results. For example, a purpose-built power supply capable of higher power levels and increased efficiency could be used. The effects of other semi-conducting materials may also improve the semi-conducting micro-hollow cathode discharge device.

Greater detail of plasmas produced in the semi-conducting micro-hollow cathode discharge device can be made using a spectrometer. The spectrometer used for the illustrative embodiments described above is capable of coupling light from a fiber optic cable. In our case, the fiber optic cable is made up of a linear bundle of 20 individual fibers, all 200 micrometers in diameter.

The spectrometer fiber feed was oriented such that the fibers are facing the exhaust plume from the side, or 90 degrees from the exhaust hole. Initially, the fibers were faced directly towards the exhaust hole. In this configuration the light output was not coupled to the fibers efficiently due to inter-fiber spacing. Based on the observations, only 3 of the available 20 fibers were collecting light output from the semi-conducting micro-hollow cathode discharge device. Changing the orientation of the fiber bundle increased the amount of light coupled to the spectrometer which increased the signal to noise ratio. To further increase the signal to noise ratio, a tightly packed circular array fiber bundle could be used.

Sampling the light from the side of the device may limit the investigation to the cooler plasma exhaust. It is believed that the hottest plasma will reside inside the discharge channel before the plasma is adiabatically cooled by expanding into a jet.

Figure 9:
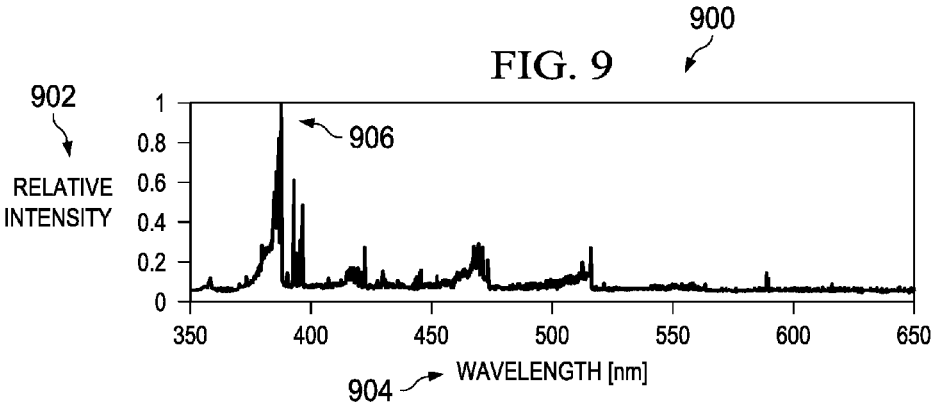
FIG. 9 is an illustration of an illustration of a graph of spectral light output of a plasma jet generated by a semi-conducting micro-hollow cathode discharge device, in accordance with an illustrative embodiment.
Figures 10, 11, 12:
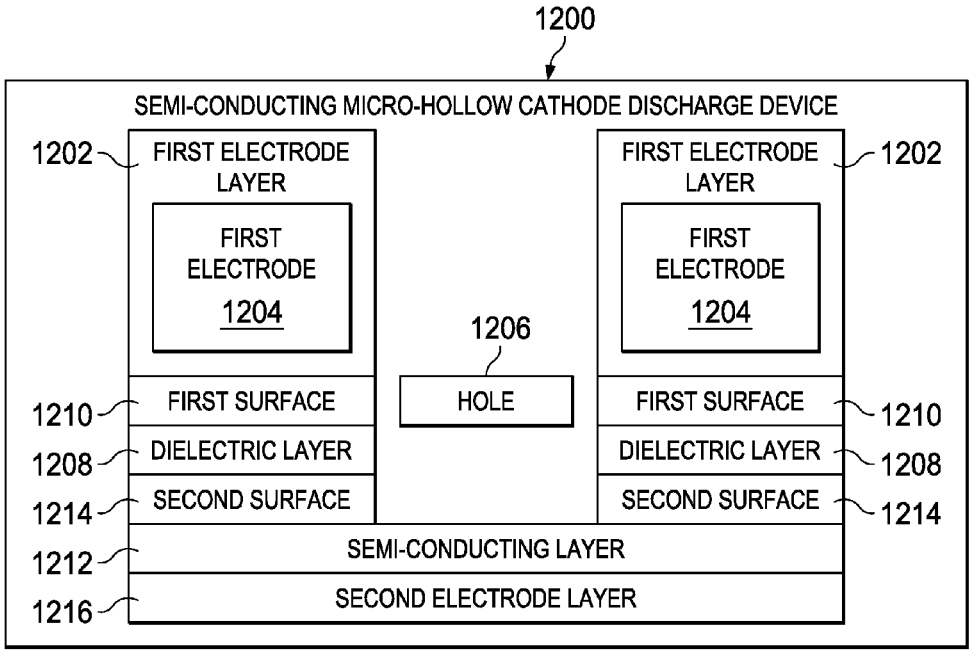
FIG. 10 is an illustration of an equation used to compute an electron temperature of a plasma jet, in accordance with an illustrative embodiment.
FIG. 11 is an illustration of a table of temperatures computed from intensity ratios of two emission lines, in accordance with an illustrative embodiment.
FIG. 12 is an illustration of a block diagram of a semi-conducting micro-hollow cathode discharge device, in accordance with an illustrative embodiment.

FIG. 9 is a graph of spectral light output of a plasma jet generated by a semi-conducting micro-hollow cathode discharge device, in accordance with an illustrative embodiment. FIG. 10 is an equation used to compute an electron temperature of a plasma jet, in accordance with an illustrative embodiment.

Graph 900 is generated using spectrometer, such as described with respect to FIG. 8. Graph 900 is a comparison of relative intensity 902 of light versus wavelength 904 of light of a plasma jet generated using the semi-conducting micro-hollow cathode discharge device described above with respect to FIG. 1 through FIG. 4.

An example of the light output spectrum obtained during the specific experiment described above is shown in FIG. 9. Using the high resolution grating of 1800 l/m accurate identification of excitation lines was possible. The spectroscopic data shown in graph 900 has a spectral resolution of 0.07 nm. Tabulated data from a scientific reference source was used to determine identification of excitation lines shown in graph 900, such as for example excitation line 906, though graph 900 shows other excitation lines.

The bulk of the light output signal, at excitation line 906, comes from near-visible spectral lines centered around 385 nm, which are primarily copper iodine (Cu—I) excitation lines. In addition to copper, also detected were oxygen, carbon, and nitrogen excitation lines. Calculation of electron densities and ion temperatures was not performed. Using the experimental setup described above, electron temperatures (Te) were calculated by using intensity ratios of the spectral lines for the same ionizing species.

To compute Te, equation 1000 was used. Equation 1000 is shown in FIG. 10. For equation 1000, $E_{mi}$, $I_i$, $\lambda_i$, $g_{mi}A_{ni}$ are upper energy levels, line intensity, line wavelength and tabulated transition probabilities, respectively.

For the measurement taken in the example described above, the ratios of lines that were relatively close to each other were examined. The full spectra as shown in FIG. 9 was obtained by combining multiple shots of plasma jets. During each shot we were able to obtain approximately 20 nm of the full spectra. Therefore, for the temperature calculations only, the spectral lines that were obtained within this window for each shot are used.

A number of copper emission lines were seen during testing; in particular, Cu—I lines at 380.05 nm, 384.82 nm, 386.08 nm, 388.17 nm and 393.30 nm. To obtain temperature information, oxygen emission lines were chosen due to the availability of emission coefficients in the National Institute of Standards and Technology (NIST) database. The results, shown in Table 1100 of FIG. 11, below, indicate that electron temperatures generated are between about 1-2 eV. The accuracy of the result is based on the accuracy of the tabulated coefficient found in the NIST database.

FIG. 11 is a table of temperatures computed from intensity ratios of two emission lines, in accordance with an illustrative embodiment. Table 1100 is a table of temperatures computer from intensity ratios of two emission lines of plasma jets generated using the semi-conducting micro-hollow cathode discharge devices described with respect to FIG. 1 through FIG. 4. The values shown in Table 1100 were taken or calculated as described above with respect to FIG. 9 and FIG. 10.

As mentioned above, table 1100 indicates that the electron temperatures generated are between about 1-2 eV. The accuracy of the result is based on the accuracy of tabulated coefficient found in the NIST database.

CONCLUSIONS

The following are conclusions made with respect to the specific experiment described above in FIG. 1 through FIG. 11. A large micro-plasma jet operating in atmospheric air can be achieved with the semi-conducting micro-hollow cathode discharge device described above. Micro-plasmas generated from the 400 micrometers diameter hole are ejected up to 20 mm downstream with exhaust speeds in the excess of 45 m/s without the use of an external gas supply. Using the semi-conducting micro-hollow cathode discharge device described with respect to FIG. 1 through FIG. 4, plasmas with temperatures of 1.2-1.8 eV or 1 to 2 eV were demonstrated. The semi-conducting micro-hollow cathode discharge device of the illustrative embodiments produced large jets that rival or exceed existing flow-assisted devices already studied in great detail.

FIG. 12 is a block diagram of a semi-conducting micro-hollow cathode discharge device, in accordance with an illustrative embodiment. Semi-conducting micro-hollow cathode discharge device 1200 is a variation of the semi-conducting micro-hollow cathode discharge devices described with respect to FIG. 1 through FIG. 4.

Semi-conducting micro-hollow cathode discharge device 1200 includes first electrode layer 1202 including first electrode 1204. Hole 1206 is disposed in first electrode layer 1202.

Semi-conducting micro-hollow cathode discharge device 1200 also includes dielectric layer 1208 having first surface 1210 that is disposed on first electrode layer 1202. Hole 1206 continues from first electrode layer 1202 through dielectric layer 1208.

Semi-conducting micro-hollow cathode discharge device 1200 also includes semi-conducting layer 1212 disposed on second surface 1214 of dielectric layer 1208. Second surface 1214 is opposite first surface 1210, relative to dielectric layer 1208. Semi-conducting layer 1212 includes a semiconductor material that spans across hole 1206 such that hole 1206 terminates at semi-conducting layer 1212. Semi-conducting micro-hollow cathode discharge device 1200 also includes second electrode layer 1216 disposed on semi-conducting layer 1212 opposite dielectric layer 1208.

The illustrative embodiment described with respect to FIG. 12 may be varied. For example, a combined thickness of the first electrode layer, the dielectric layer, the semi-conducting layer, and the second electrode layer may be about 1.5 millimeters. This thickness may vary, but generally is on the order of centimeters or less.

In a specific illustrative embodiment, the hole is about 0.4 millimeters wide in a direction perpendicular to the combined thickness. However, the hole size may vary, generally on the order of 10 mm or less.

In another illustrative embodiment, the semi-conducting micro-hollow cathode discharge device may be a printed circuit board. However, other materials may be used, and the illustrative embodiments are not limited to printed circuit boards. Generally, any flame retardant dielectric material may be appropriate. In a more specific illustrative embodiment, the hole may be a vertical interconnect access hole about centered in the printed circuit board.

In an illustrative embodiment, the first electrode may be a toroidal electrode having a first area smaller than a second area of the first surface of the dielectric layer. However, the shape and the relative area of the electrodes may be varied to suit a particular application. Nevertheless, in a more specific illustrative embodiment, pads may be connected to the first electrode, the pads configured to receive electrical contacts.

In another specific illustrative embodiment, the semi-conducting layer may be carbon tape. The carbon tape may completely cover the second surface. The carbon tape has a first area, the second electrode has a second area, and the first area and the second area may be both smaller than a third area of the second surface of the dielectric layer. In still other illustrative embodiments, other semi-conducting materials may be used, and are not limited to carbon tape.

In yet another illustrative embodiment, the hole may be lined by a ceramic that is electrically insulating. The ceramic may be a machinable glass ceramic composed of fluorphlogopite mica in a borosilicate glass matrix. However, other flame retardant ceramics may be used.

In another illustrative embodiment, the micro-hollow cathode discharge device may further include a power supply attached to the first electrode and to the second electrode. The micro-hollow cathode discharge device may also include a pulse generator attached to the power supply and configured to generate a rectangular signal for power generated by the power supply.

The micro-hollow cathode discharge device may also include a transformer connected to the power supply and configured to increase a voltage supplied to the first electrode and the second electrode. In this example, the micro-hollow cathode discharge device may also include a resistor connected in series with the power supply and the first electrode and second electrode, and configured to reduce a current supplied to the first electrode and second electrode.

In a still different illustrative embodiment, the micro-hollow cathode discharge device may include a camera disposed to take an image of the hole, a spectrometer in communication with the camera, and a computer in communication with the spectrometer. The computer, which may be data processing system 1500 of FIG. 15, may be configured to analyze spectra of the image taken using the camera when a plasma jet is emitted from the hole as a result of power being applied to the first electrode and the second electrode.

Figure 13:
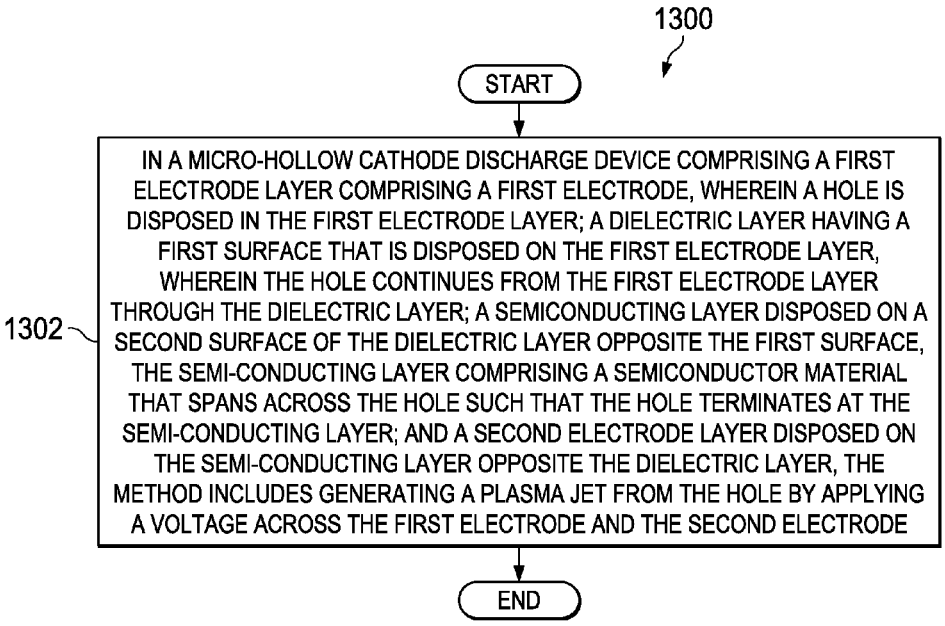
FIG. 13 is an illustration of a flowchart of a method of generating a plasma jet from a micro-hollow cathode discharge device, in accordance with an illustrative embodiment.

FIG. 13 is a flowchart of a method of generating a plasma jet from a micro-hollow cathode discharge device, in accordance with an illustrative embodiment. Method 1300 may be implemented using a semi-conducting micro-hollow cathode discharge device, such as those described with respect to FIG. 1 through FIG. 4, and FIG. 12.

Thus, method 1300 may be a method in a micro-hollow cathode discharge device comprising a first electrode layer comprising a first electrode, wherein a hole is disposed in the first electrode layer; a dielectric layer having a first surface that is disposed on the first electrode layer, wherein the hole continues from the first electrode layer through the dielectric layer; a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer. The method includes generating a plasma jet from the hole by applying a voltage across the first electrode and the second electrode (operation 1302).

This method may be varied. In just one example, generating the plasma jet may include generating the plasma jet to be greater than about 3 millimeters long. Further variations are possible.

Figure 14:
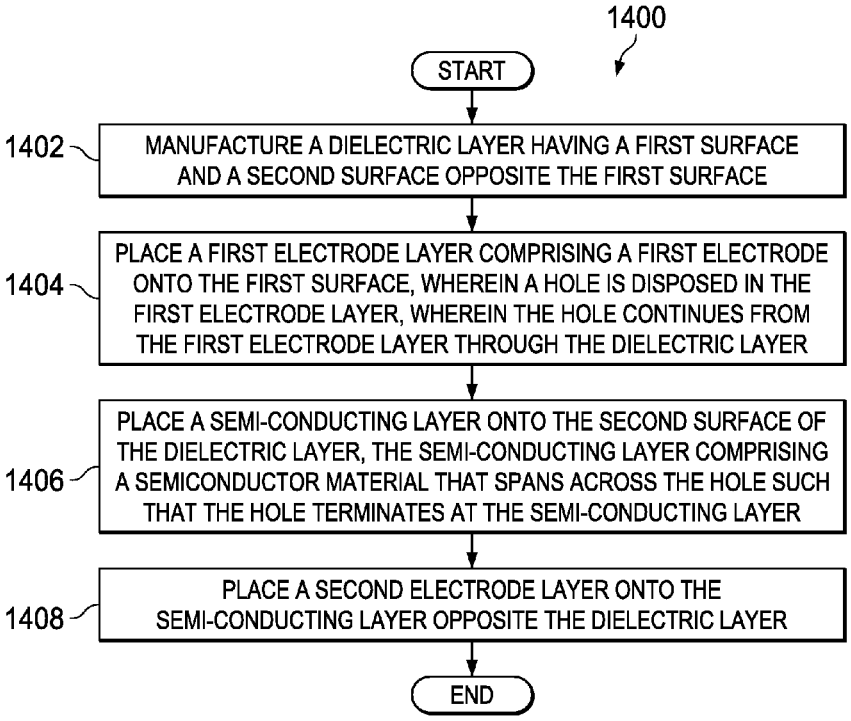
FIG. 14 is an illustration of a flowchart of a method of manufacturing a micro-hollow cathode discharge device, in accordance with an illustrative embodiment.

FIG. 14 is a flowchart of a method of manufacturing a micro-hollow cathode discharge device, in accordance with an illustrative embodiment. Method 1300 may be used to create a semi-conducting micro-hollow cathode discharge device, such as those described with respect to FIG. 1 through FIG. 4

Method 1400 may be a method of manufacturing a micro-hollow cathode discharge device. Method 1400 may include manufacturing a dielectric layer having a first surface and a second surface opposite the first surface (operation 1402). Method 1400 may also include placing a first electrode layer comprising a first electrode onto the first surface, wherein a hole is disposed in the first electrode layer, wherein the hole continues from the first electrode layer through the dielectric layer (operation 1404).

Method 1400 may also include placing a semi-conducting layer onto the second surface of the dielectric layer, the semi-conducting layer comprising a semiconductor material that spans across the hole such that the hole terminates at the semi-conducting layer (operation 1406). Method 1400 may also include placing a second electrode layer onto the semi-conducting layer opposite the dielectric layer (operation 1408). The method may terminate thereafter.

Method 1400 may be further varied. For example, as described above, different materials may be used. Different arrangements and shapes of the various layers may also be used. Accordingly, the illustrative embodiments are not necessarily limited by the example of FIG. 14, or the examples described above with respect to the other figures.

The illustrative embodiments described herein may be varied from the examples described above with respect to FIG. 1 through FIG. 14. For example, multiple semi-conducting micro-hollow cathode discharge devices may be arranged in a row as a single device, with each semi-conducting micro-hollow cathode discharge device attached to a single power supply in series. Thus, a row of jets may be generated. Other arrangements are possible. For example, multiple coordinated power supplies may be used for multiple semi-conducting micro-hollow cathode discharge devices. The semi-conducting micro-hollow cathode discharge devices may be arranged in different patterns, such as circular or elliptical or some other pattern, and thus are not limited to a row. Multiple coordinated semi-conducting micro-hollow cathode discharge devices may be arranged in a three-dimensional pattern on a larger apparatus by placing different semi-conducting micro-hollow cathode discharge devices on different parts of the larger apparatus. Thus, many different arrangements of multiple semi-conducting micro-hollow cathode discharge devices are possible.

Figure 15:
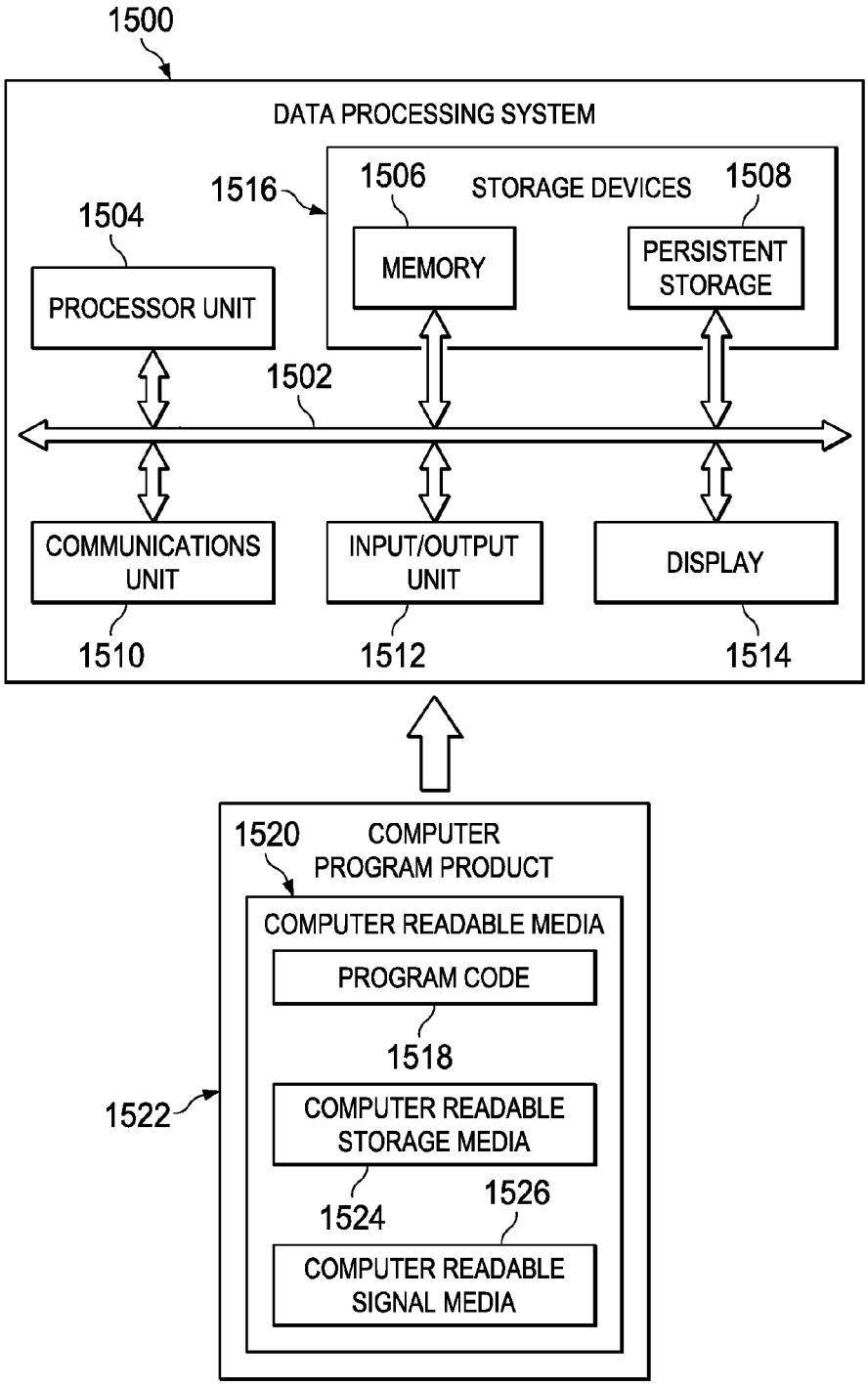
FIG. 15 is an illustration of a data processing system, in accordance with an illustrative embodiment.

Turning now to FIG. 15, an illustration of a data processing system is depicted in accordance with an illustrative embodiment. Data processing system 1500 in FIG. 15 is an example of a data processing system that may be used as part of the data taking and data processing described above for the illustrative embodiments described with respect to FIG. 1 through FIG. 14. In this illustrative example, data processing system 1500 includes communications fabric 1502, which provides communications between processor unit 1504, memory 1506, persistent storage 1508, communications unit 1510, input/output (I/O) unit 1512, and display 1514.

Processor unit 1504 serves to execute instructions for software that may be loaded into memory 1506. This software may be an associative memory, content addressable memory, or software for implementing the processes described elsewhere herein. Processor unit 1504 may be a number of processors, a multiprocessor core, or some other type of processor, depending on the particular implementation. A number, as used herein with reference to an item, means one or more items. Further, processor unit 1504 may be implemented using a number of heterogeneous processor systems in which a main processor is present with secondary processors on a single chip. As another illustrative example, processor unit 1504 may be a symmetric multiprocessor system containing multiple processors of the same type.

Memory 1506 and persistent storage 1508 are examples of storage devices 1516. A storage device is any piece of hardware that is capable of storing information, such as, for example, without limitation, data, program code in functional form, and/or other suitable information either on a temporary basis and/or a permanent basis. Storage devices 1516 may also be referred to as computer readable storage devices in these examples. Memory 1506, in these examples, may be, for example, a random access memory or any other suitable volatile or non-volatile storage device. Persistent storage 1508 may take various forms, depending on the particular implementation.

For example, persistent storage 1508 may contain one or more components or devices. For example, persistent storage 1508 may be a hard drive, a flash memory, a rewritable optical disk, a rewritable magnetic tape, or some combination of the above. The media used by persistent storage 1508 also may be removable. For example, a removable hard drive may be used for persistent storage 1508.

Communications unit 1510, in these examples, provides for communications with other data processing systems or devices. In these examples, communications unit 1510 is a network interface card. Communications unit 1510 may provide communications through the use of either or both physical and wireless communications links.

Input/output (I/O) unit 1512 allows for input and output of data with other devices that may be connected to data processing system 1500. For example, input/output (I/O) unit 1512 may provide a connection for user input through a keyboard, a mouse, and/or some other suitable input device. Further, input/output (I/O) unit 1512 may send output to a printer. Display 1514 provides a mechanism to display information to a user.

Instructions for the operating system, applications, and/or programs may be located in storage devices 1516, which are in communication with processor unit 1504 through communications fabric 1502. In these illustrative examples, the instructions are in a functional form on persistent storage 1508. These instructions may be loaded into memory 1506 for execution by processor unit 1504. The processes of the different embodiments may be performed by processor unit 1504 using computer implemented instructions, which may be located in a memory, such as memory 1506.

These instructions are referred to as program code, computer usable program code, or computer readable program code that may be read and executed by a processor in processor unit 1504. The program code in the different embodiments may be embodied on different physical or computer readable storage media, such as memory 1506 or persistent storage 1508.

Program code 1518 is located in a functional form on computer readable media 1520 that is selectively removable and may be loaded onto or transferred to data processing system 1500 for execution by processor unit 1504. Program code 1518 and computer readable media 1520 form computer program product 1522 in these examples. In one example, computer readable media 1520 may be computer readable storage media 1524 or computer readable signal media 1526. Computer readable storage media 1524 may include, for example, an optical or magnetic disk that is inserted or placed into a drive or other device that is part of persistent storage 1508 for transfer onto a storage device, such as a hard drive, that is part of persistent storage 1508. Computer readable storage media 1524 also may take the form of a persistent storage, such as a hard drive, a thumb drive, or a flash memory, that is connected to data processing system 1500. In some instances, computer readable storage media 1524 may not be removable from data processing system 1500.

Alternatively, program code 1518 may be transferred to data processing system 1500 using computer readable signal media 1526. Computer readable signal media 1526 may be, for example, a propagated data signal containing program code 1518. For example, computer readable signal media 1526 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 1518 may be downloaded over a network to persistent storage 1508 from another device or data processing system through computer readable signal media 1526 for use within data processing system 1500. For instance, program code stored in a computer readable storage medium in a server data processing system may be downloaded over a network from the server to data processing system 1500. The data processing system providing program code 1518 may be a server computer, a client computer, or some other device capable of storing and transmitting program code 1518.

The different components illustrated for data processing system 1500 are not meant to provide architectural limitations to the manner in which different embodiments may be implemented. The different illustrative embodiments may be implemented in a data processing system including components in addition to or in place of those illustrated for data processing system 1500. Other components shown in FIG. 15 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 1504 may take the form of a hardware unit that has circuits that are manufactured or configured for a particular use. This type of hardware may perform operations without needing program code to be loaded into a memory from a storage device to be configured to perform the operations.

For example, when processor unit 1504 takes the form of a hardware unit, processor unit 1504 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 1518 may be omitted because the processes for the different embodiments are implemented in a hardware unit.

In still another illustrative example, processor unit 1504 may be implemented using a combination of processors found in computers and hardware units. Processor unit 1504 may have a number of hardware units and a number of processors that are configured to run program code 1518. With this depicted example, some of the processes may be implemented in the number of hardware units, while other processes may be implemented in the number of processors.

As another example, a storage device in data processing system 1500 is any hardware apparatus that may store data. Memory 1506, persistent storage 1508, and computer readable media 1520 are examples of storage devices in a tangible form.

In another example, a bus system may be used to implement communications fabric 1502 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 1506, or a cache, such as found in an interface and memory controller hub that may be present in communications fabric 1502.

The different illustrative embodiments can take the form of an entirely hardware embodiment, an entirely software embodiment, or an embodiment containing both hardware and software elements. Some embodiments are implemented in software, which includes but is not limited to forms such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer usable or computer readable medium may contain or store a computer readable or computer usable program code such that when the computer readable or computer usable program code is executed on a computer, the execution of this computer readable or computer usable program code causes the computer to transmit another computer readable or computer usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters. The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A micro-hollow cathode discharge device, comprising:

a first electrode layer comprising a first electrode, wherein a hole is disposed in the first electrode layer;

a dielectric layer having a first surface that is disposed on the first electrode layer, wherein the hole continues from the first electrode layer through the dielectric layer;

a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer.

2. The micro-hollow cathode discharge device of claim 1, wherein a combined thickness of the first electrode layer, the dielectric layer, the semi-conducting layer, and the second electrode layer is 1.5 millimeters.

3. The micro-hollow cathode discharge device of claim 2, wherein the hole is 0.4 millimeters wide in a direction perpendicular to the combined thickness.

4. The micro-hollow cathode discharge device of claim 3, wherein the micro-hollow cathode discharge device comprises a printed circuit board.

5. The micro-hollow cathode discharge device of claim 4, wherein the hole comprises a vertical interconnect access hole about centered in the printed circuit board.

6. The micro-hollow cathode discharge device of claim 1, wherein the first electrode comprises a toroidal electrode having a first area smaller than a second area of the first surface of the dielectric layer.

7. The micro-hollow cathode discharge device of claim 6 further comprising pads connected to the first electrode, the pads configured to receive electrical contacts.

8. The micro-hollow cathode discharge device of claim 1, wherein the semi-conducting layer comprises carbon tape.

9. The micro-hollow cathode discharge device of claim 8, wherein the carbon tape completely covers the second surface.

10. The micro-hollow cathode discharge device of claim 8, wherein the carbon tape has a first area, the second electrode has a second area, and wherein the first area and the second area are both smaller than a third area of the second surface of the dielectric layer.

11. The micro-hollow cathode discharge device of claim 1, wherein the hole is lined by a ceramic that is electrically insulating.

12. The micro-hollow cathode discharge device of claim 11, wherein the ceramic comprises a machinable glass ceramic composed of fluorphlogopite mica in a borosilicate glass matrix.

13. The micro-hollow cathode discharge device of claim 1 further comprising:

a power supply attached to the first electrode and to the second electrode.

14. The micro-hollow cathode discharge device of claim 13 further comprising:

a pulse generator attached to the power supply and configured to generate a rectangular signal for power generated by the power supply.

15. The micro-hollow cathode discharge device of claim 14 further comprising:

a transformer connected to the power supply and configured to increase a voltage supplied to the first electrode and the second electrode.

16. The micro-hollow cathode discharge device of claim 15 further comprising a resistor connected in series with the power supply and the first electrode and second electrode and configured to reduce a current supplied to the first electrode and second electrode.

17. The micro-hollow cathode discharge device of claim 1 further comprising:

a camera disposed to take an image of the hole;

a spectrometer in communication with the camera; and a computer in communication with the spectrometer, the computer configured to analyze spectra of the image taken using the camera when a plasma jet is emitted from the hole as a result of power being applied to the first electrode and the second electrode.

18. A method of generating a plasma jet from a micro-hollow cathode discharge device comprising a first electrode layer comprising a first electrode, wherein a hole is disposed in the first electrode layer; a dielectric layer having a first surface that is disposed on the first electrode layer, wherein the hole continues from the first electrode layer through the dielectric layer; a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer; the method comprising:

generating a plasma jet from the hole by applying a voltage across the first electrode and the second electrode.

19. The method of claim 18, wherein generating the plasma jet comprises generating the plasma jet to be greater than 3 millimeters long.

20. A method of manufacturing a micro-hollow cathode discharge device, the method comprising:

manufacturing a dielectric layer having a first surface and a second surface opposite the first surface;

placing a first electrode layer comprising a first electrode onto the first surface, wherein a hole is disposed in the first electrode layer, wherein the hole continues from the first electrode layer through the dielectric layer;

placing a semi-conducting layer onto the second surface of the dielectric layer, the semi-conducting layer comprising a semiconductor material that spans across the hole such that the hole terminates at the semi-conducting layer; and placing a second electrode layer onto the semi-conducting layer opposite the dielectric layer.

* * * * *